United States Patent [19]

Sturm

[11] 4,082,183

[45] Apr. 4, 1978

[54] DEVICE FOR DISPLAYING WRIST WATCHES

[75] Inventor: Michael Sturm, Brookfield, Wis.

[73] Assignee: Display Corporation International, Milwaukee, Wis.

[21] Appl. No.: 712,495

[22] Filed: Aug. 9, 1976

[51] Int. Cl.[2] ..... B65D 85/40; B65D 5/50

[52] U.S. Cl. ..... 206/301; 206/566; 206/45.34; 206/45.19

[58] Field of Search ..... 206/301, 45.14, 45.19, 206/565, 566, 18, 45.34

[56] References Cited

U.S. PATENT DOCUMENTS

| | | | |
|---|---|---|---|
| 2,253,212 | 8/1941 | Rathbun | 206/566 |
| 2,925,907 | 2/1960 | Grieve et al. | 206/566 |
| 4,005,775 | 2/1977 | Crosslen | 206/566 |

FOREIGN PATENT DOCUMENTS

| | | | |
|---|---|---|---|
| 1,165,311 | 10/1958 | France | 206/301 |
| 2,114,419 | 3/1972 | Germany | 206/301 |

*Primary Examiner*—William Price
*Assistant Examiner*—Douglas B. Farrow
*Attorney, Agent, or Firm*—Michael, Best & Friedrich

[57] ABSTRACT

A wrist watch is held on a display stand including a base, laterally spaced legs depending from the base for supporting the display stand on a support surface, an arcuate lower member extending upwardly from the rear portion of the base, and a flexible, generally, inverted J-shaped cuff member extending upwardly from the front portion of the base and terminating in a free end spaced from the upper edge of the arcuate lower member. The back of the watch is received in a pocket defined by a pair of arcuate segments located on the front portion of the cuff member with one portion of the wristband extending beneath the base and over the lower member and the other portion extending around the upper portion of the cuff member. The cuff member has sufficient built-in flexibility to accommodate continuous wristbands of different sizes.

10 Claims, 4 Drawing Figures

DEVICE FOR DISPLAYING WRIST WATCHES

BACKGROUND OF THE INVENTION

This invention relates to display devices and, more particularly, to devices for displaying wrist watches.

Various devices have been used for displaying wrist watches. However, such devices typically are not capable of displaying wrist watches having a variety of different types of bands, i.e., buckle leather bands, expansion bands, fixed metal bands, etc., and bands of different sizes.

SUMMARY OF THE INVENTION

A primary object of this invention is to provide a wrist watch display device which is adapted to display watches having different types of wristbands and wristbands of different sizes.

Another principal object of the invention is to provide such a device including a display case and a separable, free-standing display stand for displaying a watch on a support surface, such as a counter top or the like.

Other objects and advantages of the invention will become apparent upon reviewing the following detailed description, the drawing and the appended claims.

The wrist watch display device provided by the invention includes a display stand having a base, leg means depending from the base for supporting the display stand on a support surface with the base spaced above the support surface, an arcuate lower member extending upwardly from the rear portion of the base and terminating in an upper edge, a flexible, generally inverted J-shaped cuff member extending upwardly from the front portion of the base and terminating in a rear free end spaced from the upper edge of the lower member. The cuff member includes means on the front portion for embracing the back of a watch with the wristband extending around the base, the lower member and the cuff member. The cuff member is provided with sufficient built-in flexibility to accommodate continuous wristbands, i.e., both fixed metal bands and expansion type bands, of different sizes.

In a preferred embodiment, the display stand is arranged to also accommodate buckled type wristbands of different lengths. For this purpose, one or more projections are provided on the inner surface of the cuff member near the free end thereof and a laterally extending slot is provided in the lower member near the upper end thereof. The wristband buckle is hooked over one of the projections, depending on the length of the wristband from the watch back to the buckle, and the other end of the wristband is passed beneath the base and is threaded through and frictionally held in place by the slot. The wristband can be tightened as necessary to snugly hold the watch on the cuff member by merely pulling the unbuckled end through the slot.

In another embodiment, a separate display case is provided for housing the display stand. The display case includes a bottom wall adapted to rest on a support surface, opposed upstanding side walls which preferably have inclined front edges, back and top walls, and a shelf or ledge located on the interior of each side wall in parallel spaced relationship to the bottom wall for slidably receiving the display stand legs and holding the display stand in place inside the case. Thus, the display case can serve both as a shipping package and as a display case for a watch.

DESCRIPTION OF THE PREFERRED EMBODIMENTS

Figure 3:
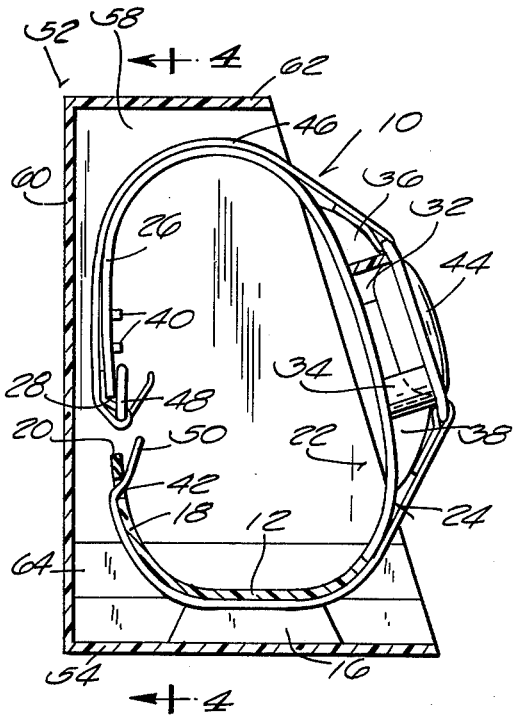
FIG. 3 is a sectional view taken along the lines 3—3 in FIG. 2.

Referring to the drawing, a display device embodying the invention includes a display stand 10 having a base 12 including a plurality of spaced legs 14, 15 and 16 (FIG. 1) depending from the opposite sides of the base for supporting the display stand 10 on a support surface, such as a counter top, with the base spaced above the support surface. While a three-legged base is illustrated in the drawing, any number of legs can be used so long as the display stand is supported in a stable manner. The legs 14, 15 and 16 preferably are located adjacent to the opposite side edges of the base 12 and include a portion 17 which extends laterally outwardly beyond the side edges of the base for a purpose to be described below.

Extending upwardly and integrally from the rear edge of the base 12 is an arcuate lower member 18 which terminates in an upper edge 20. Extending integrally from the front portion of the base 12 is a flexible, generally inverted, J-shaped cuff member 22 including a front portion 24 which extends upwardly from the front portion of the base 12 and a rear portion 26 which extends downwardly towards the lower member 18 and terminates in a free end 28 spaced from the upper edge 20 of the lower member 18. Located on the front portion 24 of the cuff member 22 is a pair of opposed, forwardly extending arcuate segments 32 and 34 which are arranged to define a pocket for receiving the back of a watch 30 (shown in phantom). Support ribs 36 and 38 can be provided to improve the structural integrity of the arcuate segments 32 and 34.

Figure 1:
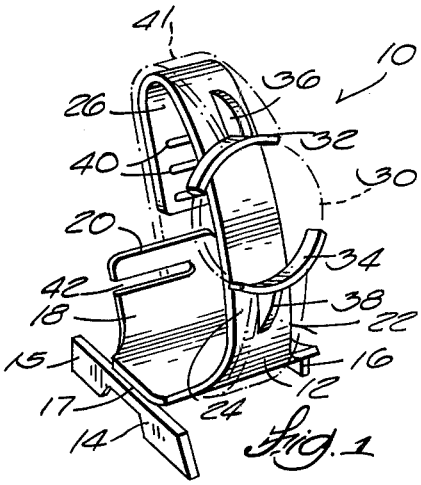
FIG. 1 is a perspective view of a free-standing wrist watch display stand embodying the invention shown holding a wrist watch having a fixed metal wristband.

The watch 30 illustrated in FIG. 1 has a fixed metal band 41 with one portion extending over the lower part of the front portion 24 of the cuff member 22, beneath the base 12 and over the lower member 18 and the other portion extending over the upper part of the front portion 24 of the cuff member 22 and over the rear portion 26 of the cuff member 22. As illustrated in the drawings, the front portion 24 of the cuff member 22 preferably is inclined rearwardly relative to the front edge of the base 12 so that the watch can be conveniently viewed by a purchaser from a location above the display stand, such as when the display stand is located on a shelf in a display counter or on top of a display counter and the purchaser is standing next to the display counter.

The cuff member 22 is provided with sufficient flexibility to accommodate continuous wristbands, either fixed metal wristbands or expansion type wristbands, of different sizes. That is, the upper portion of the cuff member 22 can be flexed downwardly from the free position shown so as to accommodate wristbands of smaller size. To accomplish this desired flexibility, the cuff member 22 can be formed from a suitable synthetic plastic material such as polystyrene. In order to minimize fabrication costs, the base 12, the lower member 18 and the cuff member 22, including the arcuate segments 32 and 34 and the support ribs 36 and 38, can be formed as a one-piece unit from such a synthetic plastic material by conventional molding techniques. If desired, the legs 14, 15 and 16 also can be formed integrally with the base 12 so that the entire display stand is a one-piece unit.

In accordance with a preferred embodiment, the display stand 10 is arranged to also hold watches having a buckle wristband. For this purpose, a plurality of forwardly extending, vertically spaced projections 40 are provided on the inner surface of the rear portion 26 of the cuff member 22 near its free end 28 and a laterally extending slot 42 is provided in the lower member 18 near the upper edge 20. The projections 40 are located, relative to the arcuate segment 32, at distances corresponding to the lengths between the back of the wrist watch and the buckle of wristbands of different conventional sizes.

Figure 2:
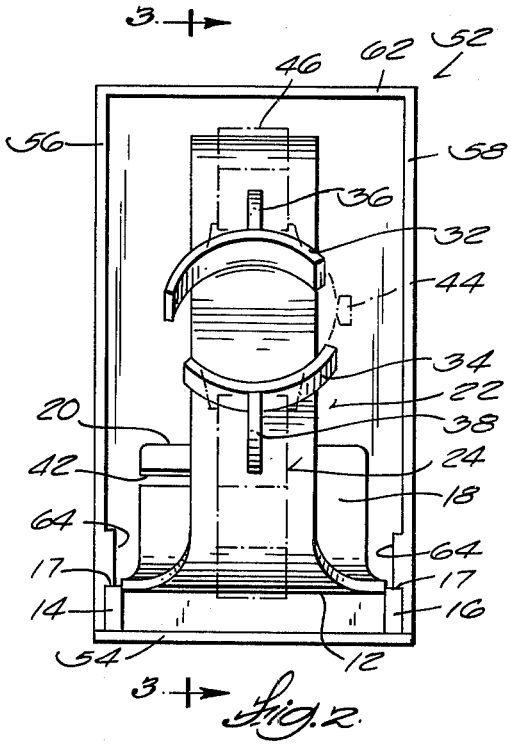
FIG. 2 is a front, elevational view showing the display stand of FIG. 1 installed in a display case and holding a wrist watch having a buckled wristband.
Figure 4:
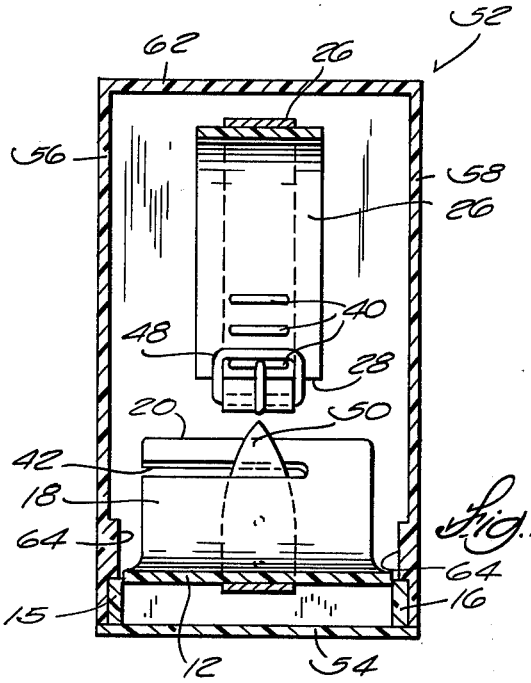
FIG. 4 is a sectional view taken along the lines 4—4 in FIG. 3.

As shown in FIGS. 2 and 4, when a watch 44 having a buckle wristband 46 is to be held on the display stand 10, the buckle 48 is hooked over the appropriate projection 40, depending on the length of the wristband from the watch back to the buckle. The unbuckled end 50 of the wristband 46 is passed beneath the base 12 and threaded through the lower member slot 42 so that a portion is behind the lower member 18 and it is frictionally engaged by the slot. The wristband 46 can be tightened to securely hold the watch 44 in place on the cuff member 22 by simply pulling on the unbuckled end 50 after it has been threaded through the lower member slot 42.

The display stand 10 can be used by itself for displaying wrist watches as shown in FIG. 1 or removably mounted in a display case 52 as shown in FIGS. 2–4. The display case 52 includes a bottom wall 54, opposed side walls 56 and 58, a rear wall 60 and a top wall 62 which cooperate to define a housing for enclosing a portion of the display stand 10. The front edges of the side walls 56 and 58 preferably are inclined at an angle generally corresponding to the incline of the front portion of the cuff member 22 (as best shown in FIG. 3) so that at least a major part of the front portion 24 of the cuff member 22 is fully exposed and the watch can be fully viewed when the display stand 10 is installed in the display case 52.

The display case 52 preferably includes means for holding the display stand in position. A shelf or ledge 64 is provided on the interior of each of the side walls 56 and 58 for this purpose. Each ledge 64 has a lower edge which is located in parallel spaced relationship to the bottom wall 54 to define an elongated recess or guideway for slidably receiving the laterally extending portion 17 of respective legs 14, 15 and 16 as best shown in FIGS. 2 and 4. The ledges 64 preferably are dimensioned so that there is minimum vertical movement of the legs relative to the display case 52 and the display stand 10 is held relatively snugly in place inside the display case. With this arrangement, the display case can be used both for displaying a watch or as part of a shipping package for a watch.

An esthetically pleasing cover having a slot adapted to accommodate the cuff member 22 and adapted to fit snugly inside the display case walls to close the open spaces between the cuff member and the display case walls can be provided if desired. Also, the display case and/or the display stand can be constructed from a transparent material so as to permit the entire watch to be viewed without removing the display stand from the display case.

While preferred embodiments of the invention have been described and illustrated in detail, it should be appreciated that various modifications and alterations can be made thereto without departing from the spirit and scope of the invention as set forth in the following claims.

I claim:

1. A display device for wrist watches including a display stand capable of free standing on a support surface, said display stand comprising a base having front and rear portions;

leg means depending from said base for supporting said display stand on the support surface with said base spaced above the support surface;

an arcuate lower member extending upwardly and integrally from the rear portion of said base and terminating in an upper edge;

a flexible, generally inverted J-shaped cuff member including a front portion extending upwardly and integrally from the front portion of said base and a rear portion extending downwardly toward said lower member upper edge and terminating in a free end spaced from said lower member upper edge; and means on the front portion of said cuff member for embracing the back of the watch with one portion of the watch wristband extending around the lower portion of said cuff member, said base and at least a portion of said lower member and the other portion of the watch wristband extending around the upper portion and said rear portion of said cuff member.

2. A display device according to claim 1 wherein said embracing means comprises a pair of opposed arcuate segments defining a pocket for receiving the back of the watch.

3. A display device according to claim 1 wherein the front portion of said cuff member extends rearwardly from said base front portion at an incline such that the watch can be conveniently viewed from a location above said display stand.

4. A display device according to claim 1 including a forwardly extending projection on the inner surface of said cuff member rear portion over which the buckle of a buckled wristband can be hooked; and a laterally extending slot in said lower member through which the unbuckled end of the watch wristband can be threaded and frictionally tightened by pulling to thereby snugly hold the watch on said cuff member.

5. A display device according to claim 4 wherein said cuff member rear portion includes a plurality of said projections which are located in vertically spaced relationship so that said display stand can accommodate watches having buckled wristbands of varying lengths.

6. A display device according to claim 3 further including a display case having opposed side walls, and rear, top and bottom walls defining a housing for removably receiving and enclosing a portion of said display stand, each of said side walls having a front edge which is inclined at an angle generally corresponding to the incline of the front portion of said cuff member so that, when said display stand is installed in said display case, at least the front portion of said cuff member is exposed.

7. A display device according to claim 6 wherein said display stand base includes opposed side edges, said leg means comprises at least one pair of laterally spaced legs located adjacent said base side edges and each including a portion extending laterally outwardly beyond respective of said base side edges; and said display case has a ledge located on the interior of each of said side walls in parallel spaced relationship to said bottom wall and defining a guideway for slidably receiving respective of said display stand legs and thereby holding said display stand in position inside said display case.

8. A device adapted to display wrist watches having a variety of different sizes and types of wristbands including buckled wristbands, said device including a display stand comprising a base having front and rear portions;

at least one pair of spaced legs depending from said base for supporting said display stand on a support surface with said base spaced above the support surface;

an arcuate lower member extending upwardly from the rear portion of said base and terminating in an upper edge;

a flexible, generally inverted J-shaped cuff member including a front portion extending upwardly and rearwardly at an incline from the front portion of said base and a rear portion extending downwardly toward said lower member upper edge and terminating in a free end spaced from said lower member upper edge;

first and second opposed arcuate segments located on the front portion of said cuff member and defining a pocket for receiving the back of a watch with one portion of the watch wristband extending around the lower portion of said cuff member, said base and at least a portion of said lower member and the other portion of the watch wristband extending around the upper portion and said rear portion of said cuff member;

a plurality of vertically spaced, forwardly extending projections on the inner surface of said cuff member rear portion over which the buckle of a buckled wristband can be hooked, said projections being located relative to said first arcuate segment at distances corresponding to the lengths between the back of a watch and the buckle of different size wristbands; and a laterally extending slot in said lower member through which the unbuckled end of a buckled wristband can be threaded and frictionally tightened by pulling to thereby snugly hold the watch on said cuff member.

9. A device according to claim 8 including a display case having opposed side walls, and rear, top and bottom walls defining a housing for removably receiving and enclosing a portion of said display stand, each of said side walls having a front edge which is inclined at an angle generally corresponding to the incline of the front portion of said cuff member so that, when said display stand is installed in said display case, at least the front portion of said cuff member is exposed.

10. A device according to claim 9 wherein said display stand base includes opposed side edges, said legs are located adjacent said base side edges and each includes a portion extending laterally outwardly beyond respective of said base side edges; and said display case has a ledge located on the interior of each of said side walls in parallel spaced relationship to said bottom wall and defining a guideway for slidably receiving respective of said display stand legs and thereby holding said display stand in position inside said display case.

* * * * *